United States Patent [19]

Towers et al.

[11] Patent Number: 4,489,987

[45] Date of Patent: Dec. 25, 1984

[54] MINE TOOL BIT WITH SPRING LOADED BUTTON RETAINER

[76] Inventors: John E. Towers, 203 N. Victor; Robert E. Edwards, 208 S. Jesse, both of Christopher, Ill. 62822

[21] Appl. No.: 485,719

[22] Filed: Apr. 18, 1983

[51] Int. Cl.[3] ..... E21B 10/00

[52] U.S. Cl. ..... 299/86; 299/92; 175/354

[58] Field of Search ..... 299/91, 92, 86; 175/412, 413, 354; 403/53

[56] References Cited

U.S. PATENT DOCUMENTS 2,851,295 9/1958 Chaffee ..... 299/92
3,331,637 7/1967 Krekeler ..... 299/92
4,026,605 5/1977 Emmerich ..... 299/92

FOREIGN PATENT DOCUMENTS 939370 10/1963 United Kingdom ..... 299/92

*Primary Examiner*—James A. Leppink
*Assistant Examiner*—Michael Starinsky
*Attorney, Agent, or Firm*—Rogers, Eilers, Howell, Renner, Moore & Haferkamp

[57] ABSTRACT

A mine tool bit is retained in an open ended block with a cylindrical button insert transversely mounted in the shank of the bit, the insert having a cylindrical button extending radially outwardly from the shank and biased by a coil spring. The button must be manually depressed to insert or remove the bit from the block.

15 Claims, 3 Drawing Figures

FIG. 1.
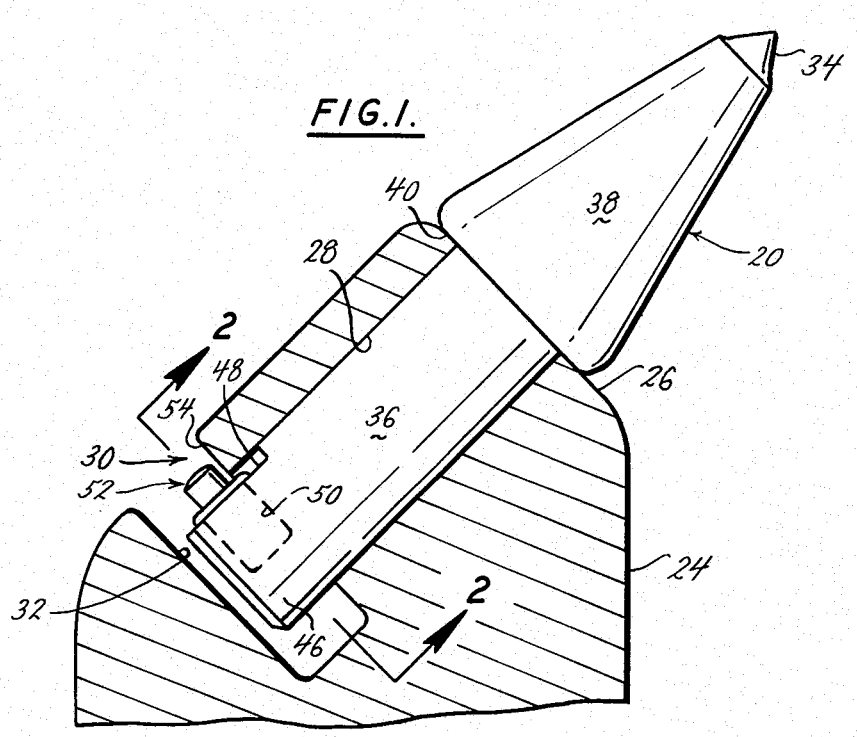
FIG. 2.
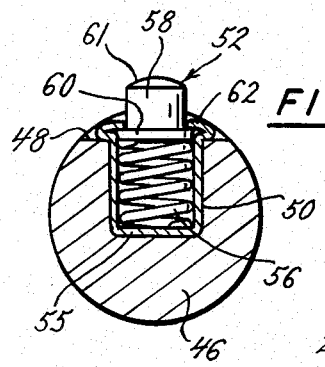
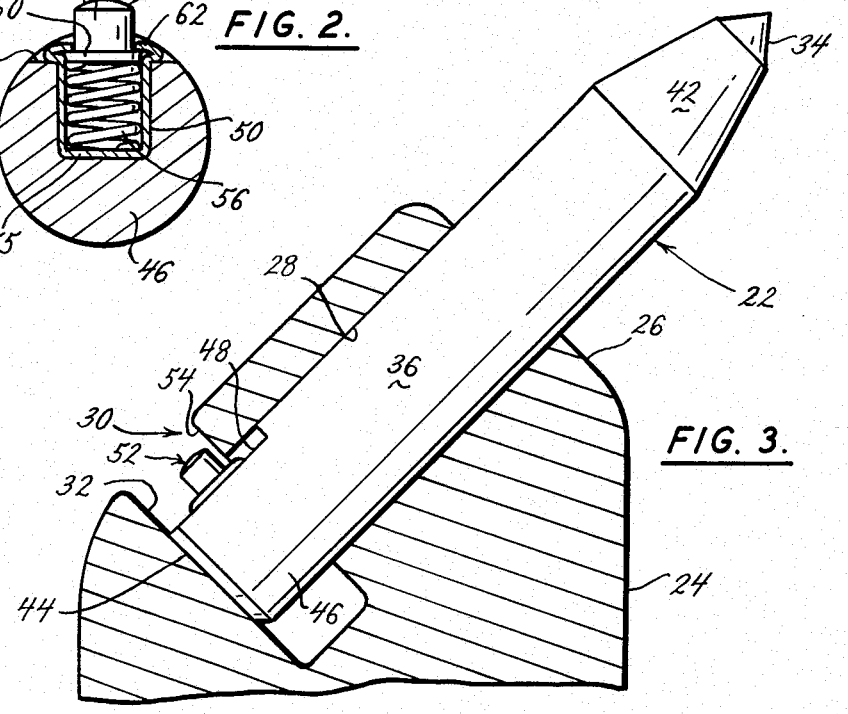
FIG. 3.

MINE TOOL BIT WITH SPRING LOADED BUTTON RETAINER

BACKGROUND AND SUMMARY OF THE INVENTION

Some mining machines, such as those presently used in coal mines, have rotating wheels or drums provided with numerous bits. These wheels or drums are equipped with bits which are driven against the seam of coal or other mineral to be extracted, and the bits penetrate the coal, mineral or other rock, breaking it up so that it can be removed. Although the bits are usually provided with a point made from hard metal alloy such as tungsten carbide, the bits wear quickly because these bits continually impact minerals and the surrounding substrate. Frequently, the softer steel in which the hard point is inset wears away and the exposed point simply pushes out or breaks off. Thus, the bits have been designed to be replaceable. During typical operations in a coal mine for instance, the bits on the miner have to be replaced twice in an eight hour shift. And, if harder rock is encountered, replacement must occur even sooner. The mining machines typically have as many as 180 bits, and it presently takes nearly an hour and a half to replace them.

The bits are of two types: the first type, often referred to as a tri-type bit has a conical head on the cylindrical shank. The second type of bit, often referred to as a pencil bit, is generally cylindrical with a front tapering to a point.

The bits are inserted into the blocks at the optimum cutting angle, and the blocks are mounted to rotating drums or wheels on the miner. The most common type of block is the tri-type block, such as that manufactured by the Joy Manufacturing Company. These blocks have a generally cylindrical bore with an open breach end. The shank of the bit is received in the bore with the back end of the bit protruding through the open breach end.

In the tri-type bit axial loads from impacting the rock are borne by the shoulder on the bit at the abutment of the head and shank, which engages the block. In the pencil type bit, axial loads are supported by an abutting surface provided at the back of the block in alignment with the bore.

It is important that the bits be securely mounted in the blocks. Each bit weighs approximately a pound and is a very dangerous projectile if it flies off the rotating wheel or drum. However, as just discussed, the bits must be removable for replacement. In addition, the bit must be allowed to rotate in the bore so that the bit wears evenly and dust is prevented from caking in the bore and wedging the bit permanently in the block.

Before this invention there was no fast and secure way to rotably mount a bit in a block. A number of methods of engaging the bits are disclosed in Krekeler, U.S. Pat. No. 3,397,012 and Krekeler, U.S. Pat. No. 3,397,013 both issued Aug. 13, 1968. The most common way to mount the bit was to provide a circumferential groove around the shank of the bit near the end, so that the groove would be exposed at the open breach end of the block. A heavy gage wire hose clamp was then expanded with a pair of pliers and the clamp slid over the end of the shank into the groove, wherein it was allowed to close. The clamp in the groove prevented the bit from sliding out of the block.

The hose clamp mounting, although heretofore the best available and most widely used method, presented numerous problems. The clamp was hard to manipulate, especially in the confined breach opening in the block. Each worker had to carry special pliers to operate the clamps, as well as a supply of spare clamps which were easily lost. The dark, dusty underground environment compounded the problems of using the clamps, since the only light to work by was from the workers helmet. The result was that it would take nearly one and one half hours to change the over 180 bits on a typical mining machine. Because causing delay, the difficulties with installing the clamps often resulted in a bit being improperly secured, so that during use it could fly out of the block.

Emmerich U.S. Pat. No. 4,026,605 discloses a double ball retainer on the shank of the bit that is received in an annular groove in the back of the block. This was not the tri-type of block now most commonly used, and to which the present invention herein relates. As that patent states, prior to the double ball retainer most retainers were mounted in the bore of the block, for example sometimes a circular retainer, known in the art as a "wedding band" was carried in an annular groove in the rear of the block.

In Emmerich, the balls had to be retained in the bit above their equator, and this left little surface to engage the block and resist outward motion of the bit. This was at least partially intentional because there was no access to the interior of the block, meaning that the bit had to be removable by pulling on the bit. It was not uncommon for the head of the bit to shear off during service and the shank become stuck in the bore. To prevent failure in removal, there had to be minimal resistance to outward motion. This was totally inconsistent with safety because a mounting method which allowed bits to be easily removed would also let a bit fly off during use. Another problem was that special tools were needed so that a worker could engage the head of the bit and drive it free from the block.

After a while in service, the annular groove in the block would wear, making it even easier for the bit to escape. Furthermore, dust working its way down the bore between the bit and bore would collect in the annular groove and facilitate a camming action urging the balls out of engagement with the block. Thus, the Emmerich device was wholly unsatisfactory for use in the tri-type blocks. For safety's sake, the bits must be securely mounted in the block. The rounded ball retainer simply did not achieve this, for so long as they could be jerked free it was not sufficiently secure. What was needed was a way to releasably secure the bit cooperating with the open breach end, and easily assessible therefrom. This brings up another failing of the double ball retainer, in that if one ball was accessible, the other wasn't and the bit could not be released if the balls achieved a truely secure engagement. Thus, until this invention, the only way to mount bits to the tri-type blocks was the cumbersome hose clamp method.

Still another disadvantage with the Emmerich device was the close fit machined surfaces required to mount the retaining device in the shank of the bit. As can be appreciated, there can be quite a number of bits in a mining machine, and their useful life may be less than a shift in the mine. Thus, the expense involved in manufacturing a bit is critical in determining its applicability. These machined surfaces to close tolerance can be achieved only at a significant expense which increases the cost of each bit.

The present invention provides a bit that is easier to install and remove from the blocks, and thus makes replacement faster and more reliable. The bit is provided with an insert having a spring-loaded cylindrical button extending radially from the shank near the rear of the bit. A rough drilled hole can be made in the shank, and the insert secured in the hole with an epoxy or other adhesive, thereby eliminating the machining expense of prior art devices. The button is compressible so that the bit can be inserted through the bore in the block. When the button passes beyond the breach opening in the block it extends outwardly, and the sidewall of the button engages the end of the bore in the block preventing the bit from sliding out of the bore. The button may, with some effort, be depressed by the worker so that the bit can be slid from the bore. However, since it is a flat side which is engaging the block, there is no camming action or other force tending to depress the button during operation. The worker needs no special tool or extra parts to mount or remove the bits. Removal and installation of the bits is greatly simplified so that despite the difficult environment, the bits are securely mounted and fly off incidents are virtually eliminated. The result is that a job that used to take nearly one and one half hours can be accomplished in less than half the time.

The present invention, therefore, makes the mine environment safer by more reliably engaging bits in the blocks. Furthermore, it causes a substantial savings because it reduces the down time of the mining machine and the other equipment waiting on the miner to mine coal. Since the mining machine can mine as much as ten tons of coal in 30 seconds, every minute saved is important. With the present invention the increased safety and efficiency are achieved at reduced cost over prior art devices.

BRIEF DESCRIPTION OF THE DRAWINGS

FIG. 1 is a side view of a mining bit provided with an insert and retaining button according to this invention, mounted in a block shown in cross section;

FIG. 2 is a cross sectional view of the bit along line 2—2 in FIG. 1 showing the insert and retaining button in cross section;

FIG. 3 is a side view of a second type of mining bit provided with an insert and retaining button according to this invention, mounted in block shown in cross section;

DETAILED DESCRIPTION OF THE PREFERRED EMBODIMENT

Referring to FIGS. 1 and 3, mining bits 20 and 22, respectively, are shown mounted in a block 24. Block 24 might be mounted, for instance, on the rotating drum or wheel of a continuous miner like those presently used in coal mines. Block 24 has a flat front face 26. A cylindrical bore 28 in the front face extends through block 24 to access opening or breach 30. Aligned with bore 28, across opening 30, is an anvil surface 32.

Bits 20 and 22 are typically made of high alloy steel, and are provided with an insert 34 at the tip. Insert 34 is typically made of tungsten carbide. Bits 20 and 22 each have a cylindrical shank 36 which is rotably received in bore 28 of block 24.

Bit 20, known in the art as a tri-type bit, has a conical head 38. The juncture between head 38 and shank 36 forms shoulder 40. Axial loads on bit 20 are borne by shoulder 40 engaging front face 26 of block 24. Bit 22, known in the art as a pencil type bit, has a tapering head 42 on its front end. Axial loads on bit 22 are borne by the back 44 of bit 22 engaging anvil 32 of block 24.

When bits 20 and 22 are properly seated in block 24, rear portion 46 of shank 36 protrudes from bore 28 into opening 30. A planar region 48 is cut in rear portion 46 of shank 36 parallel to the axis of shank 36. A rough cut hole 50 is provided in region 48 to receive a spring loaded button insert 52. Insert 52 retains the bit 20 or 22 in block 24 by engaging end 54 of block 24.

As best seen in FIG. 2, insert 52 comprises a cup-like housing 55, a coil spring 56, a cylindrical button 58 having a brim 60 around its circumference at the lower end and a dome 61 at its top, and a retaining ring 62 around the top of the housing. Cylindrical button 58 is biased outwardly through ring 62 by spring 56, but is trapped by the engagement between brim 60 and ring 62. A pre-assembled button insert is commercially available such as those available from the Econo Trading Company in Rockford, Ill.

The planar configuration of region 48 permits mounting of button insert 52 so that only cylindrical button 58, but not retaining ring 62 protrudes from the profile of shank 36. The planar configuration of region 48 also makes it easier to position and machine hole 50. Location of hole 50 is important, since it is sometimes desirable that button insert 52 be located as far forward on shank 36 as possible so that when a bit is mounted, cylindrical button 58 is close to end 54 of bore 28, eliminating axial play of the bit in block 24.

Button insert 52 can be secured in hole 50 by a variety of means, however, the use of commercially available adhesives has been found to be satisfactory, while avoiding the need for close tolerances and expensive shop procedures of other methods, such as press fitting. One example of a satisfactory adhesive is K-G 633(TM) from Bill Stein Company in Northbrook, Ill.

OPERATION

The mounting, operation, and removal of bits 20 and 22 are similar and will be described in general terms applicable to both. The bit is easily mounted in block 24 by depressing button 58 until only the dome 61, or less, protrudes from the cross sectional profile of shank 36. Shank 36 can then be inserted into bore 28 of block 24. As the dome 61 has a curvilinear surface, it will cam the button 58 the rest of the way into the bore 28 in the same manner as the prior art devices may be inadvertently released. Shank 36 is slid into bore 28 until the rear portion 46 of shank 36 protrudes into opening 30. When the bit is properly seated in the block, button 58 will have passed completely through bore 28. Once in opening 30, button 58 extends outwardly through force of spring 56. In this extended position, button 58 prevents outward motion of the bit by engaging end 54 of bore 28, although some limited axial movement may be permitted.

In some applications, button insert 52 is located as far forward on shank 36 as possible so that there is little room for the bit to slide forward before button 58 engages end 54 of bore 28. Once properly seated, the bit can freely rotate in block 24, thus the bit wears evenly. Because of the flat face the side of button 58 presents to end 54 of bore 28, the bit cannot be removed without manually depressing button 58. Although button 58 firmly secures the bit to block 24, button 58 in no way interferes with the rotation of the bit because of the size of opening 30.

The bit is easily removed by turning the bit so that button 28 is accessible from opening 30, and then depressing button 58. As with insertion, dome 61 aids in removal through its camming action.

There are various changes and modifications which may be made to applicant's invention as would be apparent to those skilled in the art. However, any of these changes or modifications are included in the teaching of applicant's disclosure and he intends that his invention be limited only by the scope of the claims appended hereto.

I claim:

1. A mine tool having a cylindrical shank for rotable mounting in a block on a mining machine, said block having at least a partially open ended cylindrical bore in which the shank is rotably received and through which the end of the shank protrudes for access thereto, said mine tool including:

means defining a generally radially extending hole in the end of the shank which protrudes from the bore when mounted in said block;

an insert fixedly secured in said hole, said insert having a cylindrical button telescopically mounted therein; and, means biasing said cylindrical button outwardly from the profile of the shank, said cylindrical button having an appreciable portion thereof extending beyond the insert, the block having a generally flattened surface against which the side of the button abuts to prevent inadvertent dislodging of the tool during use.

2. The device of claim 1 wherein the button is located immediately behind the end of the bore when the shank is mounted therein.

3. The device of claim 1 wherein the insert further comprises a cup-like housing having an annular cap at the top thereof, and wherein the button has a circumferential brim, the button protruding through the cap but secured to the housing by engagement between the brim and cap.

4. The device of claim 3 wherein the housing is secured in the hole by an adhesive.

5. The device of claim 1 wherein the shank has a generally planar region in its side and at the end thereof which protrudes from the bore when mounted therein, and wherein the insert is secured to the shank in said planar region.

6. The device of claim 1 wherein the cylindrical button has a dome shaped head to aid in insertion and withdrawal of the tool from the block.

7. The device of claim 1 wherein the tool may be withdrawn from the block only upon depressing the button substantially into the insert.

8. The device of claim 1 wherein the mine tool is a bit for a machine designed to remove coal.

9. A mine tool having a cylindrical shank for rotable mounting in a block on a mining machine, said block having at least a partially open ended cylindrical bore in which the shank is rotably received and through which the end of the shank protrudes for access thereto, said mine tool comprising:

a planar region in the side of the shank and at the end thereof which protrudes from the bore when mounted therein;

means defining a hole in the planar region, an insert fixedly secured in said hole, said insert having a cylindrical button having a portion thereof extending radially outwardly from the shank, said radially extending portion of said cylindrical button being immediately behind the end of the bore when the shank is mounted therein, said bore end being generally flattened; and, means for resiliently telescopically mounting the button in the insert, said button thereby retaining the mine tool in the block upon insertion until said button is manually depressed beyond the curvilinear profile of the bore for removal.

10. The device of claim 9 wherein the insert comprises:

a cup-like housing in which the button is telescopically received;

a button biasing means including a coiled spring, and, wherein said button has a circumferential brim at its lower end, the housing having an annular cap at its top through which the button protrudes, the cap securing the button in the housing by engagement between the brim and cap.

11. The device of claim 10 wherein the housing is secured in the hole with adhesive.

12. The device of claim 9 wherein the cylindrical button has a dome shaped head to aid in insertion and withdrawal of the tool from the block.

13. The device of claim 9 wherein the tool may be withdrawn from the block only upon depressing the button substantially into the insert.

14. The device of claim 9 wherein the mine tool is a bit for a machine designed to remove coal.

15. A mine tool having a cylindrical shank for rotable mounting in a block on a mining machine, said block having at least a partially open ended cylindrical bore to receive the shank, and through which the end of the shank protrudes for access thereto, said mine tool including means defining a generally radially extending hole in the exposed end of the shank which protrudes from the bore when mounted to the block, an insert fixedly secured in the hole by an adhesive, said insert including a cup-like housing, the housing having an exposed annular cap at its top, a cylindrical button telescopically mounted within the housing, the button having a circumferential brim which engages the cap to retain the button within the housing and a dome shaped head to aid in insertion and removal of the tool from the bore, and a coil spring in the housing to bias the button brim against the housing cap, an appreciable portion of the button extending beyond the cap to engage the end of the bore and prevent unintended removal of the tool from the block.

* * * * *